US005961355A

United States Patent [19]

Morlion et al.

[11] Patent Number: 5,961,355

[45] Date of Patent: Oct. 5, 1999

[54] HIGH DENSITY INTERSTITIAL CONNECTOR SYSTEM

[75] Inventors: Danny L. C. Morlion, Gant, Belgium; Ab van Zanten, Hertogenbosch, Netherlands

[73] Assignee: Berg Technology, Inc., Reno, Nev.

[21] Appl. No.: 08/992,042

[22] Filed: Dec. 17, 1997

[51] Int. Cl.[6] ..... H01R 13/502

[52] U.S. Cl. ..... 439/686; 439/79

[58] Field of Search ..... 439/607–609, 439/79, 108, 686, 701

[56] References Cited

U.S. PATENT DOCUMENTS

| | | | |
|---|---|---|---|
| Re. 32,691 | 6/1988 | Dola et al. | 439/608 |
| 3,474,383 | 10/1969 | Mahon et al. | 439/717 |
| 4,415,214 | 11/1983 | Obst | 439/717 X |
| 4,740,180 | 4/1988 | Harwath et al. | 439/848 X |
| 4,846,727 | 7/1989 | Glover et al. | 439/608 |
| 4,975,084 | 12/1990 | Fedder et al. | 439/608 |
| 4,976,628 | 12/1990 | Fedder | 439/101 |
| 5,046,960 | 9/1991 | Fedder | 439/108 |
| 5,066,236 | 11/1991 | Broeksteeg | 439/79 |
| 5,104,341 | 4/1992 | Gillissen et al. | 439/608 |
| 5,174,770 | 12/1992 | Sasaki et al. | 439/608 X |
| 5,286,212 | 2/1994 | Broeksteeg | 439/108 |
| 5,342,211 | 8/1994 | Broeksteeg | 439/108 |
| 5,403,206 | 4/1995 | McNamara et al. | 439/608 |
| 5,484,310 | 1/1996 | McNamara et al. | 439/608 |
| 5,496,183 | 3/1996 | Soes et al. | 439/79 |
| 5,605,476 | 2/1997 | McNamara et al. | 439/608 |
| 5,607,326 | 3/1997 | McNamara et al. | 439/608 |
| 5,795,191 | 8/1998 | Preputnick et al. | 439/608 |

FOREIGN PATENT DOCUMENTS

| | | | |
|---|---|---|---|
| 0 442 643 B1 | 2/1991 | European Pat. Off. . | |
| 0 486 298 B1 | 11/1991 | European Pat. Off. | 23/68 |
| 0 670 615 A1 | 3/1994 | European Pat. Off. . | |
| 0 638 967 A2 | 7/1994 | European Pat. Off. . | |
| 0 700 131 A1 | 8/1994 | European Pat. Off. . | |

*Primary Examiner*—Khiem Nguyen

*Attorney, Agent, or Firm*—Brian J. Hamilla; M. Richard Page; Daniel J. Long

[57] ABSTRACT

A novel high density receptacle is disclosed. The receptacle includes a housing portion, having a plurality of openings formed in its front face. A first column containing a first number of contact elements is positioned in relation to the housing so that the receiving portions of the contact elements are aligned with certain of the openings. A second column containing a second number of contact elements is positioned in relation to the housing so that the receiving portions of the contact elements are aligned with other of said openings. It is preferred for the receptacle to include a plurality of said first and second columns, wherein the columns are arranged side by side in an alternating pattern. The first column preferably includes a first wafer, wherein the contact elements are attached to said first wafer. A peg is formed on one of the side surfaces of the first wafer. The second column is preferably constructed similar to the first column, however, the second wafer to has a bore formed therein. When the first and second wafers are arranged side by side, the peg of the first wafer is inserted into the bore of the second wafer.

25 Claims, 17 Drawing Sheets

HIGH DENSITY INTERSTITIAL CONNECTOR SYSTEM

FIELD OF THE INVENTION

The present invention relates to electrical connectors, and more particularly, to high density plug and receptacle connector systems wherein the plug and receptacle contacts have been assigned specific signal and voltage levels in order to provide electrical signal integrity.

BACKGROUND OF THE INVENTION

Continued advances in the design of electronic devices for data processing and communications systems are placing rigorous demands on electrical connectors. Specifically, electrical connectors having higher densities and pin counts are needed for design advances which increase integration of solid state devices and which increase the speed of data processing and communication. Designing connectors to have higher densities and higher pin counts requires careful consideration of the problems which result from decreasing the distance between contacts. Primarily, as the distance between contacts decreases, the likelihood of undesirable electrical cross talk between contacts increases.

Density and pin count are often viewed interchangeably, but there are important differences. Density refers to the number of signal contacts provided per unit length. In contrast, the number of contact elements that can reasonably withstand the mating and unmating forces is referred to as the pin count.

As more functions become integrated on semiconductor chips or on flexible circuit substrates and more chips are provided on printed circuit boards (PCBs), each PCB or flexible circuit must provide more inputs and outputs (I/Os). The demand for more I/Os directly translates to a demand for greater density.

Moreover as signal frequency increases, which will occur as speed of data processing and communication increases, traditional approaches to connector design are less applicable. The connectors used in high-speed board-to-board, board-to-cable and cable-to-cable communications may be treated for design purposes like transmission lines in which crosstalk and noise become significant concerns. Indeed, the electrical performance of high-speed board-to-board, board-to-cable and cable-to-cable communications is dependent upon the amount of crosstalk and noise introduced at the connector interface.

As was recognized in U.S. Pat. No. 4,824,383—Lemke, incorporated herein by reference, an important connector design consideration is the provision of an electrical connection while avoiding degradation of component performance. Prior to this patent, connector designs had been proposed in which a ground plane and alternating ground contacts together with shielding extensions were introduced to minimize electrical discontinuities, i.e., crosstalk and noise. While performance was controlled in such prior devices, density was limited.

U.S. Pat. No. 4,824,383 proposed designs for plug and receptacle connectors for multiple conductor cables or multiple trace substrates. In such designs individual contact elements or groups of contact elements were electrically isolated to prevent or minimize crosstalk and signal degradation. In the individually isolated design, a conductive base plate was provided with a number of walls arranged in side-by-side relationship, thereby defining a number of channels. A contact support member formed from electrical insulating material was designed to have a number of fingers, wherein a finger was positioned within each channel. Each finger of the contact support member supported an individual contact element.

Although, the connectors disclosed in U.S. Pat. No. 4,824,383 increased contact element density, industry driven density demands continued to grow. U.S. Pat. Nos. 5,057,028—Lemke et al. and 5,169,324—Lemke et al. (now U.S. Pat. No. Re. 35.508), all incorporated herein by reference, disclose two row plug and receptacle connectors for attachment to printed circuit boards (PCBs), which provided increased density. Although, this plug and receptacle system provided higher contact density, electrical isolation was achieved primarily between sets of contacts by continuous metal structures rather than between individual contacts.

In an attempt to provide isolation between individual contacts, various design schemes have been proposed. These design schemes can be generally categorized as a coaxial structure (a single contact fully surrounded by a conductor), a pseudo coaxial structure such as a twinax structure (dual contacts surrounded by a conductor), as a microstrip structure (a number of contacts provided on one side of a single ground plane), and as a stripline structure (a number of contacts sandwiched between two ground planes).

U.S. Pat. Nos. 4,846,727, 5,046,960, 5,066,236, 5,104,341, 5,496,183, 5,342,211 and 5,286,212 disclose various forms of stripline structures incorporated into a plug and receptacle system. Generally, however, these systems can be described as providing columns of contact elements having conductive plates disposed between each column. The connectors are designed so that the plug and receptacle ground plates contact one another. Each row of receptacle contact elements are molded into a frame of dielectric material. The overall receptacle assembly, thus includes, a housing to which the ground plates and dielectric frames are attached in alternating layers.

Particular reference is made in U.S. Pat. No. 5,046,960, which indicates that such connectors may not be desirable for high density applications due to the amount of dielectric material between each contact. This patent suggests that if one were to reduce the amount of dielectric material, the electrical characteristics of the connector, particularly impedance characteristics, would also be changed. It is stated that a desire would be to have a connector which provides a more dense array of contact members while maintaining the electrical characteristics associated with less dense connectors. Electrical characteristics are said to be achieved, in part, by the provision of air reservoirs immediately surrounding portions of the grounded, continuous conductive plates. Outer shields are also disclosed for surrounding the receptacle exterior. One of the problems of this system, however, is that due to the continuous structure of the conductive plates and the presence of dielectric material between the conductive plates, the speed by which signals may pass through the connector is being limited.

The present invention concerns, in part, a modification to the coaxial and twinax isolation schemes described thus far. It has been found that satisfactory isolation can be achieved by selecting particular contact elements in an array as signal and ground contacts. One such example is where a central contact in an array is selected for the transmission of a potential cross talk producing signal and the surrounding contacts are all connected to ground. Such contact element patterns are suggested in U.S. Pat. Nos. 5,174,770, 5,197,893 and 5,525,067.

One of the problems with the above described connector systems is that the contact element density remains insufficient for certain applications. Moreover, where the ground plate is a continuous metal structure, the capacitance or impedance characteristics of such a structure become more significant as speed increases. Increasing signal speed, as used herein, means decreasing rise time. When rise time decreases to a point where it is smaller than the propagation delay time characteristic of the connector structure, unwanted cross talk will occur.

Consequently, a need still exists for a connector system which maximizes the number of contact elements available for ground/signal assignment while minimizing cross talk.

SUMMARY OF THE INVENTION

It has been noted that many of the above described problems can be resolved and other advantages achieved in a high density connector system when one considers the capacitance characteristics at the point of interconnection. In this regard, for high speed signals, i.e., signals having fast rise times, the prior connector system problems can be overcome when the ratio of connector propagation delay time to signal rise time is taken into consideration in connector construction. Connector propagation delay time is related to the capacitance characteristics of the connector system when interconnection distance is generally considered constant.

In the connector system of the present invention, the receptacle component of the system includes a housing portion, having a plurality of openings formed in its front face. A first column containing a first number of contact elements is positioned in relation to the housing so that the receiving portions of the contact elements are aligned with certain of the openings. A second column containing a second number of contact elements is positioned in relation to the housing so that the receiving portions of the contact elements are aligned with other of the openings.

It is preferred for the receptacle to include a plurality of the first and second layers forming columns of contacts, wherein the layers are arranged side by side in an alternating pattern. In this embodiment, it is also preferred for the housing to have a cover member having a series of projections and recesses formed thereon. The first layers are positioned proximate the projections and the second layers are positioned proximate the recesses or grooves.

It is also preferred for the housing to have a top surface and further to have an alignment projection formed on the top surface.

In one embodiment, the first layer includes a first wafer, wherein the contact elements are attached to the first wafer. Preferably the contact elements are molded into the first wafer. In this embodiment, the first wafer is formed from insulating or dielectric material. The first wafer also includes a peg formed on one of the side surfaces of the first wafer. The peg preferably has a split configuration. In this embodiment, it is preferred for the second layer to be constructed similar to the first layer, i.e., to include a second wafer, wherein the contact elements are attached to the second wafer. Instead of projections, however, it is preferred for the second wafer to have a bore formed therein. When the first and second wafers are arranged side by side, the peg of the first wafer is inserted into the bore of the second wafer.

It is also preferred for the number of contact elements in the first wafer to be odd while the number of contact elements in the second wafer is even. It is also preferred for the number of contact elements to differ by one between the first and second wafers. In this way, the receptacle portions and the tail portions can be arranged in an alternating fashion requiring less space for circuit board attachment, i.e., a high density receptacle.

In such high density interconnections, pin assignments can achieve desired isolation effects. To this end several pin assignments have been set forth. For example, the receiving portions of the first layers may be preselected to be connected to ground. In such an embodiment, it may also be arranged for the receiving portions of the second layers to each receive signals.

BRIEF DESCRIPTION OF THE DRAWINGS

The present invention will be better understood and its numerous objects and advantages will become apparent by reference to the following detailed description of the invention when taken in conjunction with the following drawings, in which.

DETAILED DESCRIPTION OF THE INVENTION

The present invention is described below in relation to a high density connector system in an environment in which signals representative of digital data are transmitted. In order to describe certain structural features of the invention and in order to understand certain advantages of the invention, reference is made to high speed signals, i.e., signals having fast rise times. It will be appreciated that such signals are by nature pulse type signals, wherein the rise time represents the time necessary for the signal to transition from a lower logic level to a higher logic level. In this regard, reference is also made to the phenomena of propagation delay and reflection. It is noted that such descriptions are for illustration purposes and are not intended to be limits on the scope or application of the invention.

Figure 1:
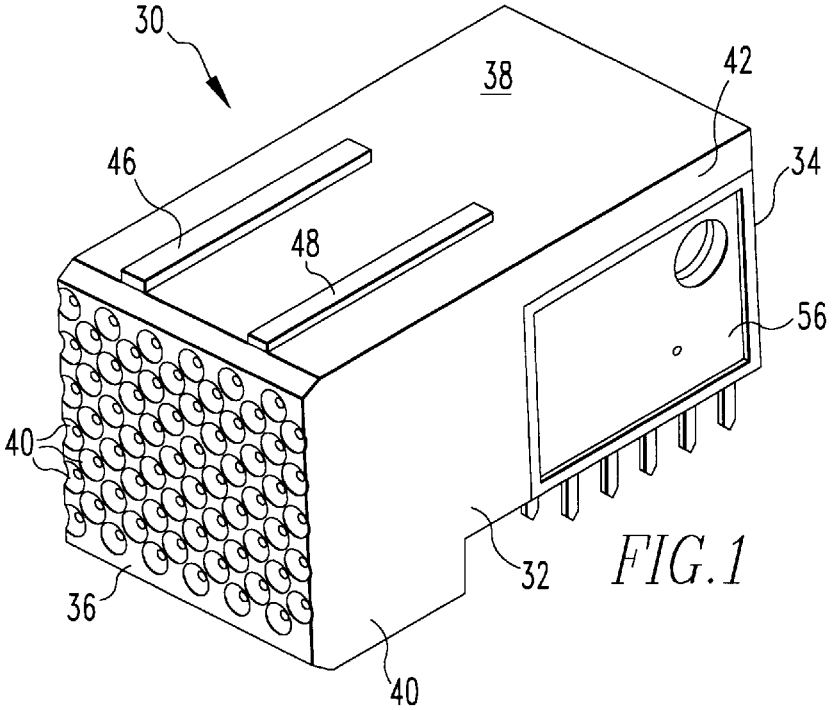
FIG. 1 is a perspective view generally depicting a receptacle constructed in accordance with the present invention.

A receptacle connector 30 for use in an electrical connector system constructed in accordance with the present invention is generally shown in FIG. 1. It has been found that high density connectors can achieve high speed performance, i.e., the ability to transmit pulse type signals exhibiting very short rise times, if one is mindful to match impedance and avoid reflection. To this end, it is noted that higher signal speed involves smaller signal rise times. If the propagation delay of the connector is greater than the signal rise time, reflection will occur. It is noted that connector propagation delay is related to impedance mismatch. If the propagation delay can be held to a value which is smaller than half the rise time of the signal being transmitted, then impedance should be sufficiently matched so that reflection should not occur to any significant degree. The connector embodiments of the present invention incorporate structure which minimizes capacitance, maximizes signal speed and thus minimizes propagation delay and cross talk.

Receptacle connector 30 is shown to include a housing portion 32 and a contact mounting portion 34. Housing 32 includes a front wall 36, top surface 38, a forward orienting portion 40 and a rearward mounting portion 42. A series of openings 44 are formed in front wall 36. Openings 44 preferably are arranged in an interstitial pattern, i.e., the openings are arranged in columns wherein the openings in one column are in offset relation to the openings in an adjacent column. As will be appreciated below, each opening 44 has associated therewith a corresponding contact element.

Figure 2:
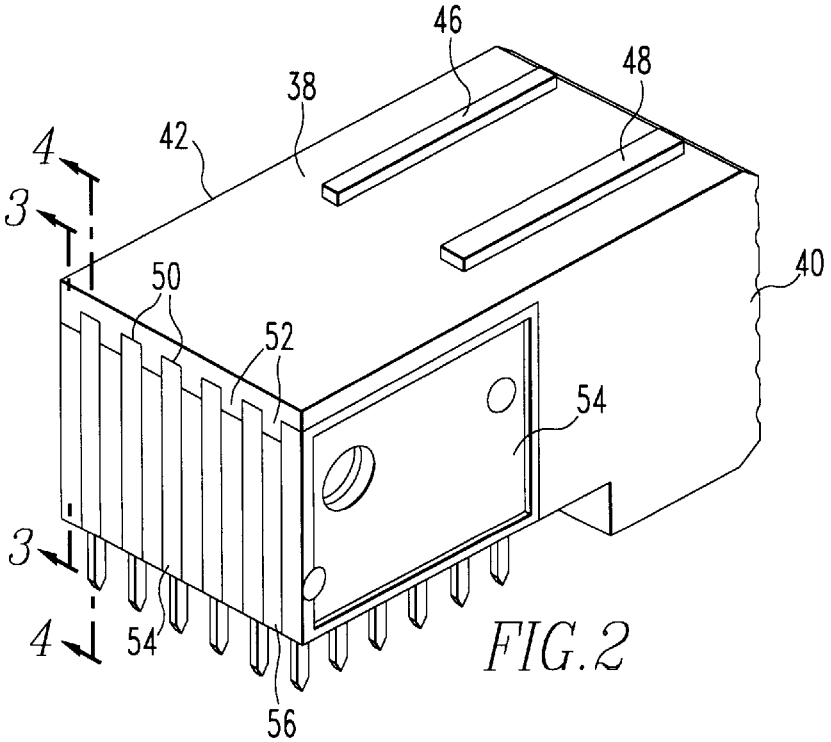
FIG. 2 is a reverse angle perspective view of the receptacle depicted in FIG. 1.

Referring now to FIG. 2, receptacle 30 is shown in a reverse angle prospective view. Mounting portion 42 is shown to include the series of slots, 50 and projections 52. As will be described in relation to FIGS. 3 through 8, the contact elements assembled in receptacle 30 are provided in modular form. In particular, module 54 provides 6 contact elements and module 56 provides 5 contact elements.

Figure 3:
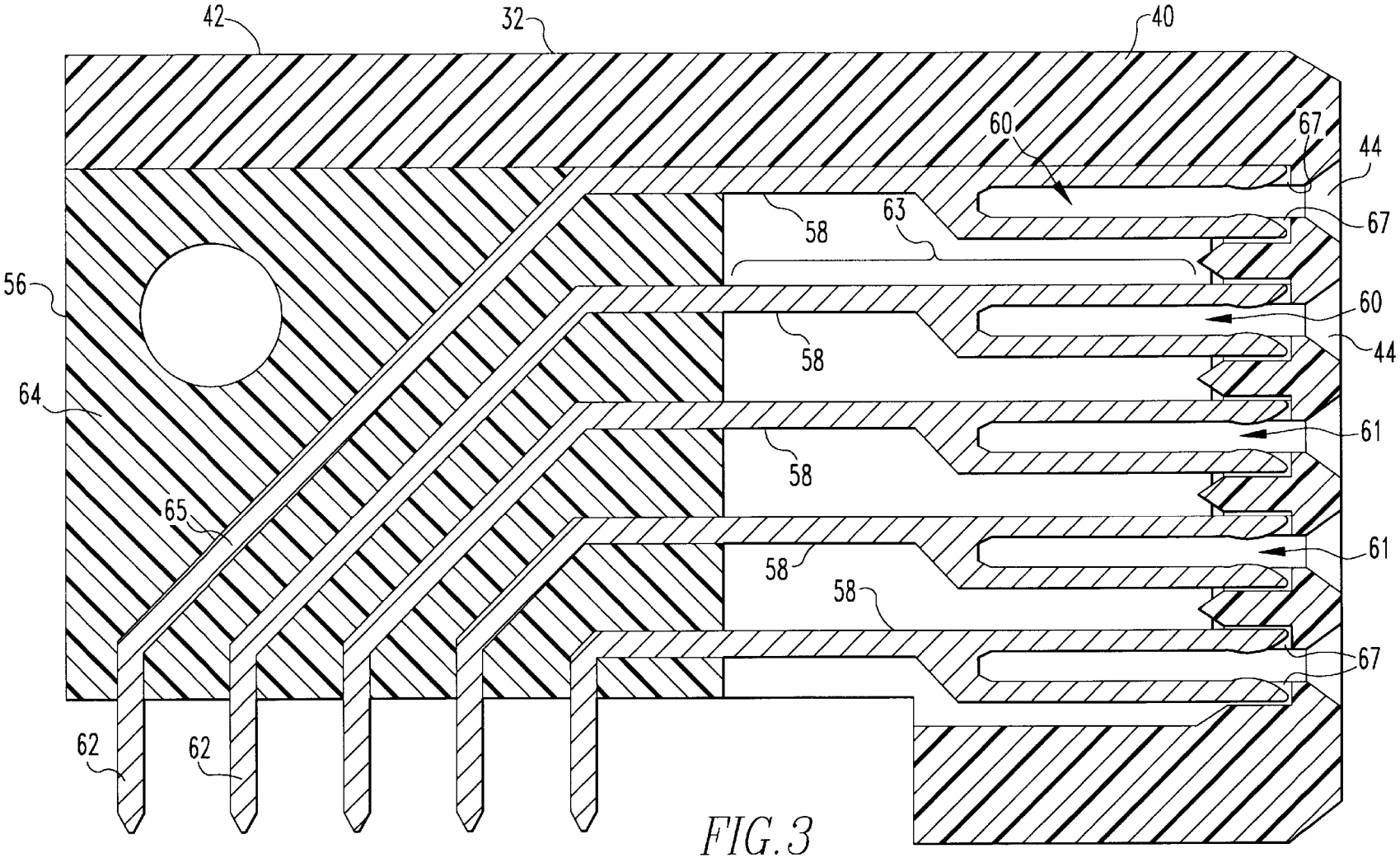
FIG. 3 is a sectional view taken along the line 3—3 in FIG. 2.

Referring now to FIG. 3, module 56 is shown to include a series of contact elements 58 each contact element is provided with a receptacle portion 60 and a tail portion 62. The contact elements 58 are molded within wafer 64. Wafer 64 is preferably formed from a dielectric material. Although not previously mentioned, it is also preferred for housing 32 to be formed from insulating material. As shown in FIG. 3, each receptacle end 60 of contact element 58 is associated with a separate opening 44 in the front wall 36 of housing 32.

Figure 4:
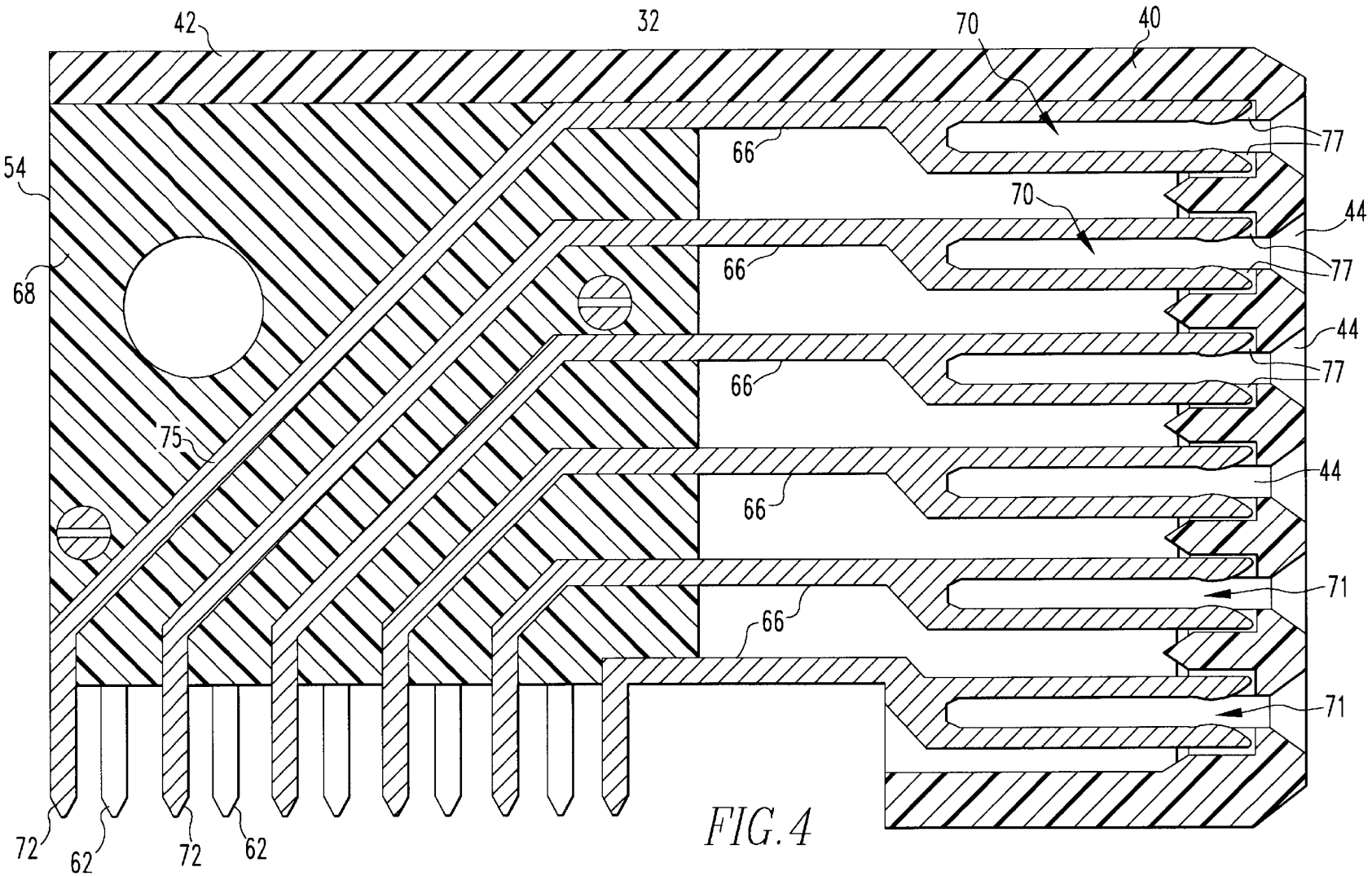
FIG. 4 is a sectional view taken along the line 4—4 in FIG. 2.

Referring now to FIG. 4, module 54 is shown in greater detail. The number of contact elements 66 are molded within wafer 68 each contact element includes a receptacle portion 70 and a tail portion 72. Similar to receptacle portions 60, shown in FIG. 3, receptacle portion 70 are each associated with an opening 44 and the front wall 36 of housing 32. It is again preferred for wafer 68 to be formed from a dielectric material. It is noted that tails 62 and 72 are arranged in a staggered or offset relationship. This offset or interstitial relationship carries forward to receptacle portions 60 and 70. It would be appreciated from a comparison of FIG. 3 and FIG. 4 that the outermost receptacle portions 70 are positioned outwardly from the outermost receptacle portion 60. As will be appreciated from the whole pattern depicted on front wall 36, the receptacle ends 60 of module 56 are offset or positioned laterally in between the receptacle ends 70 of module 54. It is noted that the offset relationship between receptacle ends 60 and 70 also results in a degree of horizontal overlap which will be explained in greater detail in relation to FIGS. 11–13.

Figure 5:
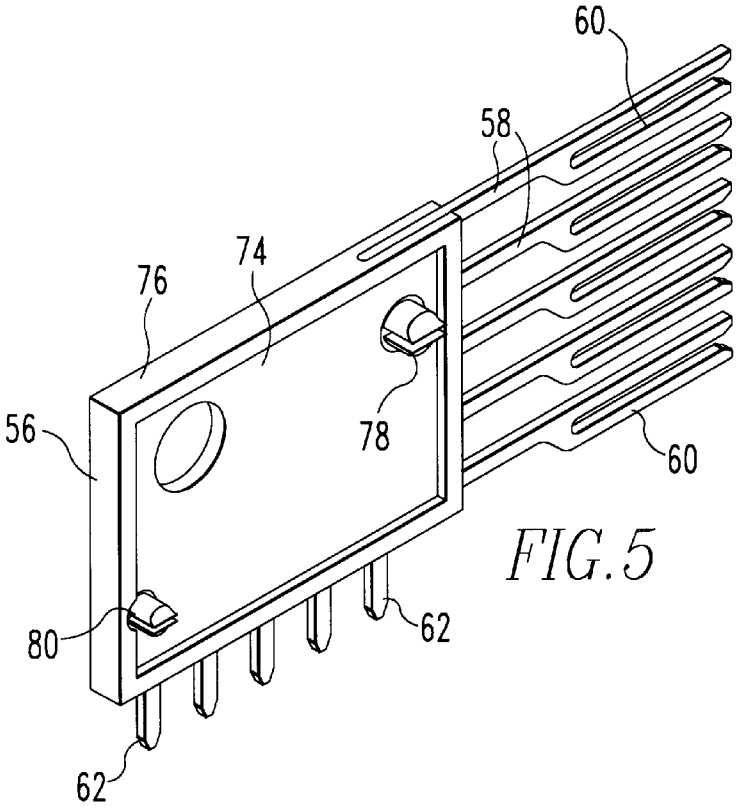
FIG. 5 is a perspective view of the contact module depicted in cross section in FIG. 3.
Figure 6:
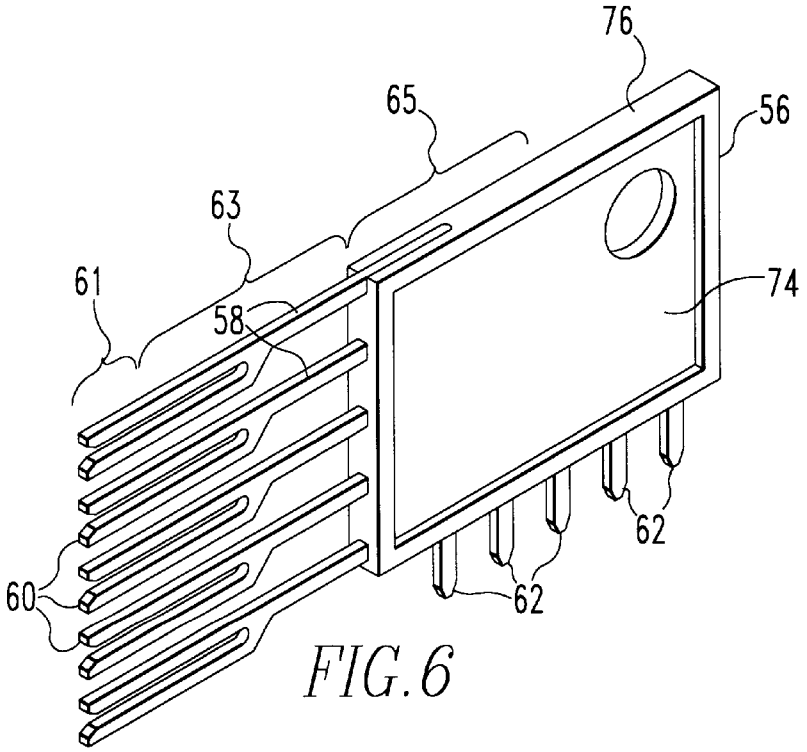
FIG. 6 is a reverse angle perspective view of the contact module depicted in cross section in FIG. 5.

Referring now to FIGS. 3, 5 and 6, module 56 will be disclosed in still greater detail. Module 56 is shown to include a generally planar central portion 74 which is surrounded by a raised outer wall 76. Wall 76 acts as a projection extending outward from both sides of central portion 74. A pair of mounting pegs 78 and 80 are provided on one side of module 56. As shown in FIG. 5, each mounting peg comprises a split peg construction. As will be appreciated, the forward diameter of peg 76 is slightly greater than the bore (not shown) in which it is inserted. The split peg design permits good frictional engagement. In the preferred embodiment, central portion 74, outer wall 76 and pegs 78 and 80 are integrally formed around the contact elements.

Each module 56 includes a plurality of contact elements 58. Each contact element 58 has a forward portion 61, a middle portion 63, a fixing portion 65 and a tail portion 62. Fixing portions 65 are attached to or disposed within central portion 74 so that the contact elements are fixed and aligned relative to one another. As depicted in FIG. 3, the contact element column is positioned in relation to housing 32 so that the only portions of the contact elements 58 which can potentially engage housing 32 are forward portions 61 which engage orienting portion 40. Forward portions 61 are held in place by pockets 67 formed on the inner side of front wall 36 and surrounding each opening 44. Middle portions 63 do not make any contact with housing 32, but rather, are not in contact with any dielectric structure and no dielectric structure is present between the contact elements. Preferably, middle portions 63 are surrounded by air. By surrounding middle portions 63 with air, the effective capacitance of receptacle 30 is minimized and propagation delay is minimized.

Figure 7:
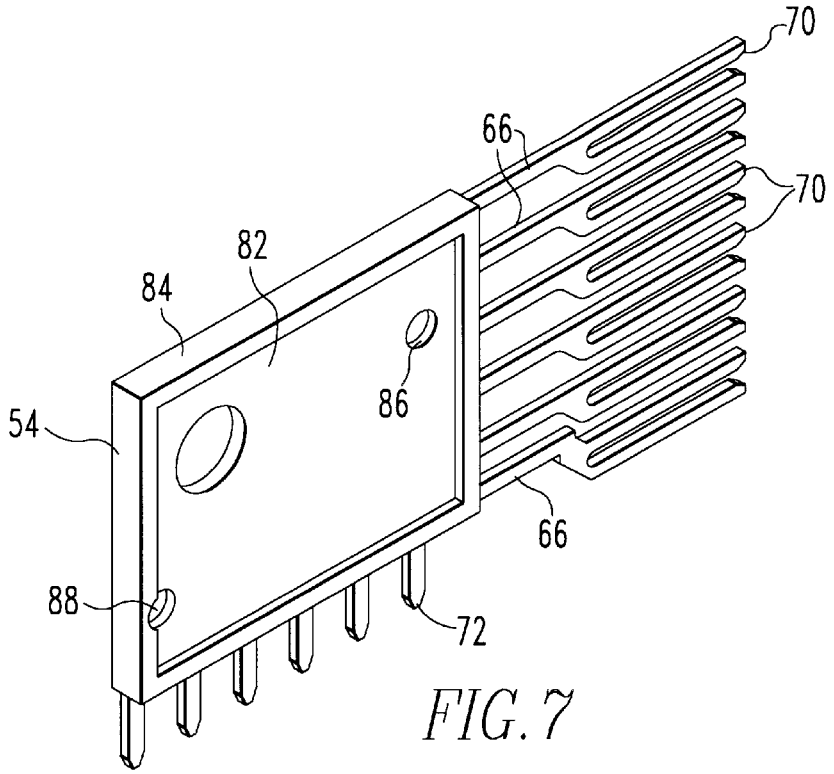
FIG. 7 is a perspective view of the contact module depicted in cross section in FIG. 4.
Figure 8:
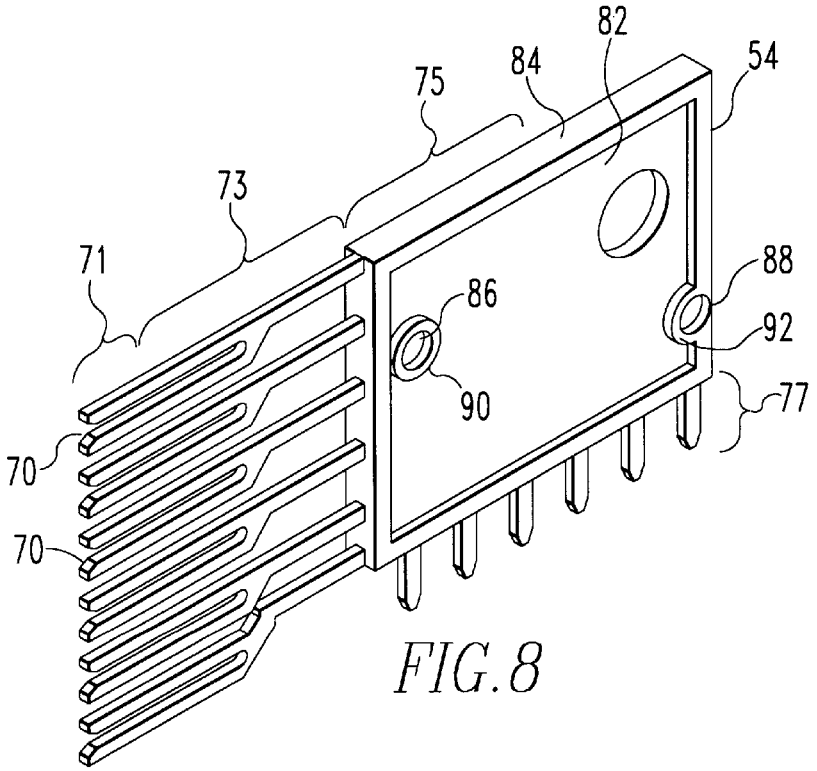
FIG. 8 is a reverse angle perspective view of the contact module depicted in cross section in FIG. 7.

Referring now to FIGS. 4, 7 and 8, module 54 is described in greater detail. Module 54 includes a number of contact elements 66 which have been molded into a wafer formed from dielectric material. Wafer 68 is shown to include a generally planar central portion surrounded by a raised shoulder or border portion 84. Shoulder 84 extends outward from central portion 82 around its circumference. It will be appreciated, that when central portions 54 and 56 are assembled as shown in FIG. 2, raised shoulders 76 and 84 (See FIGS. 6 and 8) act to form air spaces between the central portions. The creation of such air spaces acts to further minimized the effective capacitance of receptacle 30 resulting in increased speed/minimized propagation delay. A pair of bores 86 and 88 are formed in module 54 as shown in FIG. 8, bores 86 and 88 include a collar 90 and 92, respectively.

Each module 54 includes a plurality of contact elements 66. Each contact element 66 has a forward portion 71, a middle portion 73, a fixing portion 75 and a tail portion 72. Fixing portions 75 are attached to or disposed within central portion 82 so that the contact elements are fixed and aligned relative to one another. As was depicted in FIG. 4, the contact element column is positioned in relation to housing 32 so that the only portions of the contact elements 66 engaging housing 32 are forward portions 71 which engage orienting portion 40. Forward portions 71 are held in place by pockets 77 formed on the inner side of front wall 36 and surrounding each opening 44. Middle portions 73 do not make any contact with housing 32, but rather, are not in contact with any dielectric structure and no dielectric structure is present between the contact elements. Preferably, middle portions 73 are surrounded by air. By surrounding middle portions 73 with air, the effective capacitance of receptacle 30 is minimized and propagation delay is minimized.

It will be appreciated from a review of FIGS. 5 through 8 that split peg 78 and 80 are intended to be inserted into bores 86 and 88 thereby holding module 56 and 54 together. It is noted in relation to FIGS. 5 through 8 that the middle portions 63 and 73 are surrounded by air. This structural arrangement results in an effective dielectric constant which is close to 1. Such a low effective dielectric constant tends to minimize crosstalk, reduces the signal propagation delay-time-to-rise-time ratio and aids in achieving a closer impedance match between the connector and those systems interconnected by the connector.

It is noted, that although they may be different in number from column to column, contact elements 58 and 66 are generally identical in construction. Such identity of structure permits greater flexibility when assigning signal and ground pins. Moreover, forward portions 61 and 71 include inwardly facing bumps which serve to enhance wiping and retention functions.

Figure 9:
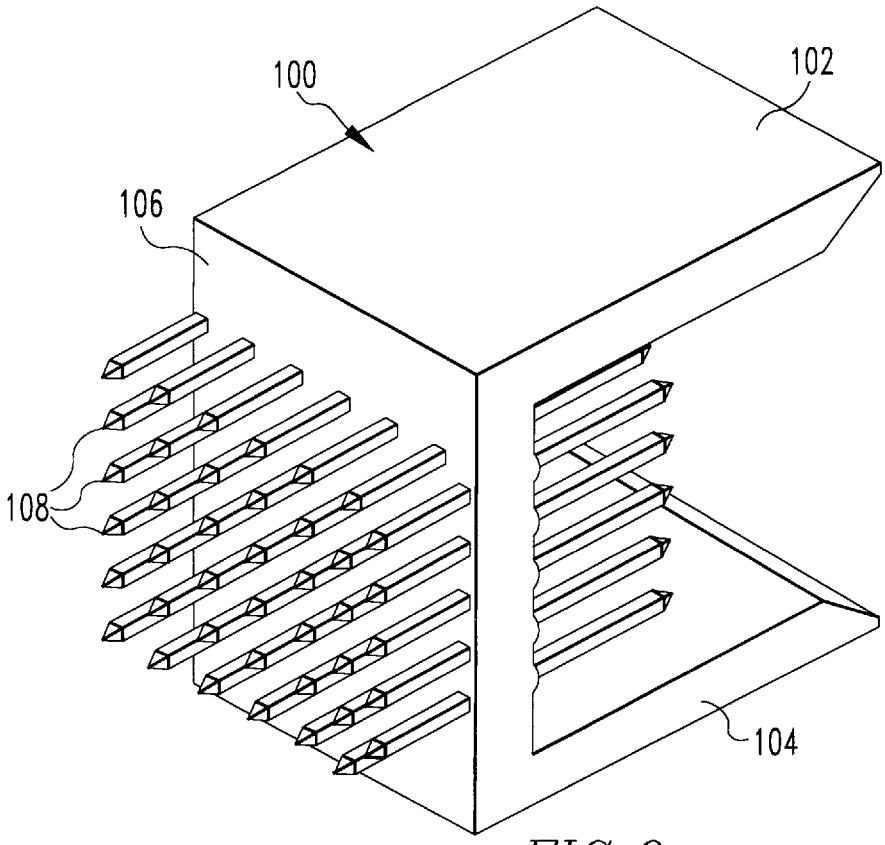
FIG. 9 is a bottom perspective view of a plug constructed in accordance with the invention.
Figure 10:
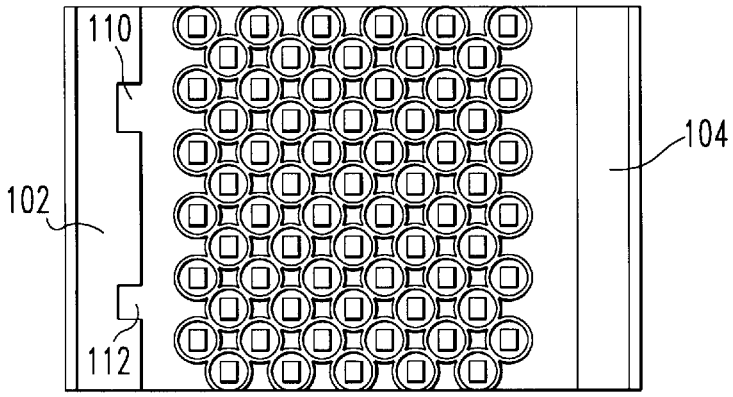
FIG. 10 is a top view of the plug depicted in FIG. 9.

Referring now to FIGS. 9 and 10, a pin header 100 is disclosed. Header 100 is shown to include two sidewalls 102 and 104, as well as a base portion 106. A plurality of pins 108 are positioned in base 106. It will also be appreciated from FIG. 10 that pins 108 are arranged in an alternating pattern corresponding to the pattern of holes 44 in front wall 36 of housing 32.

Figure 11:
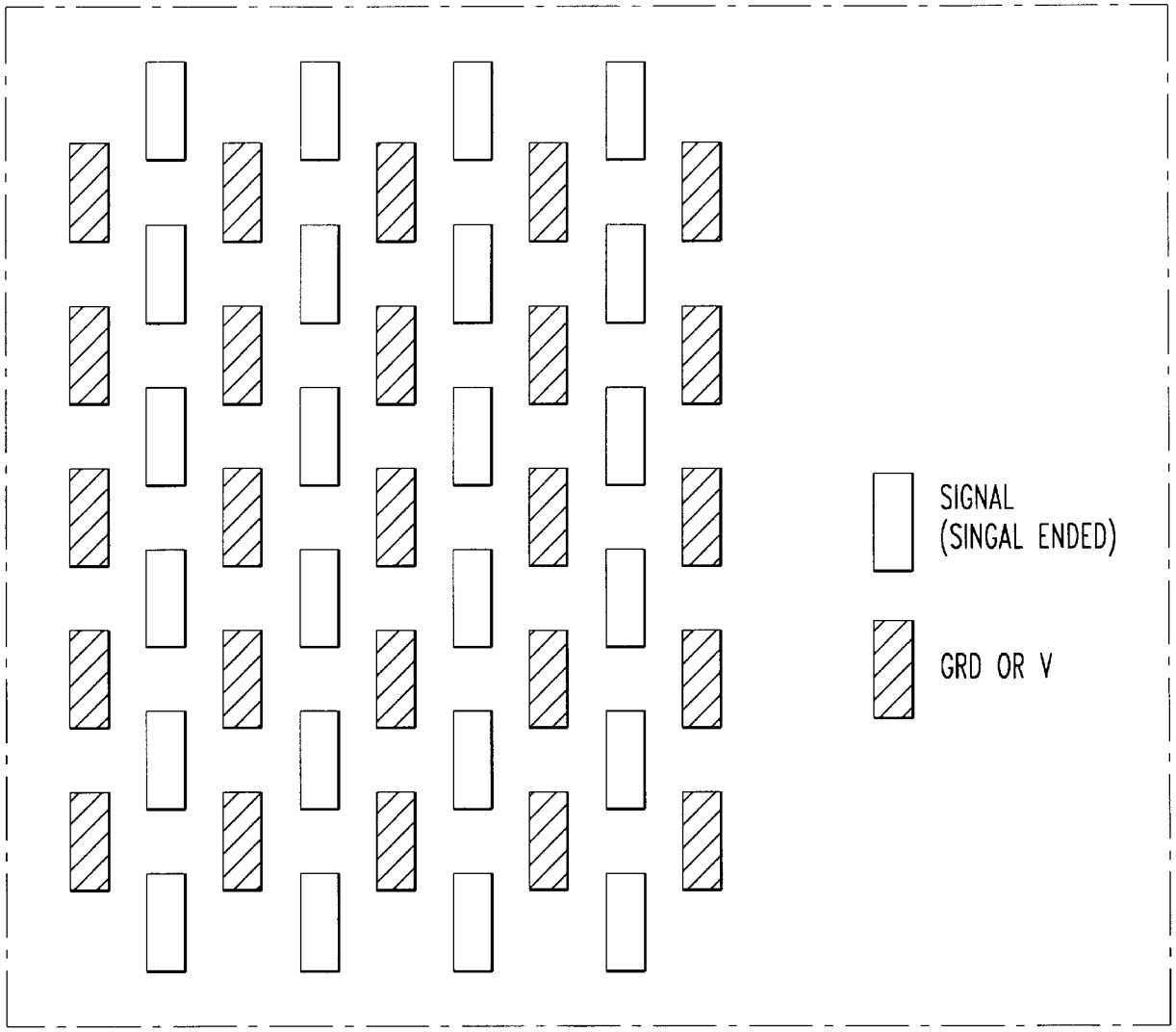
FIG. 11 is a diagrammatic view of a pattern of signal assignments made in accordance with the present invention.
Figure 12:
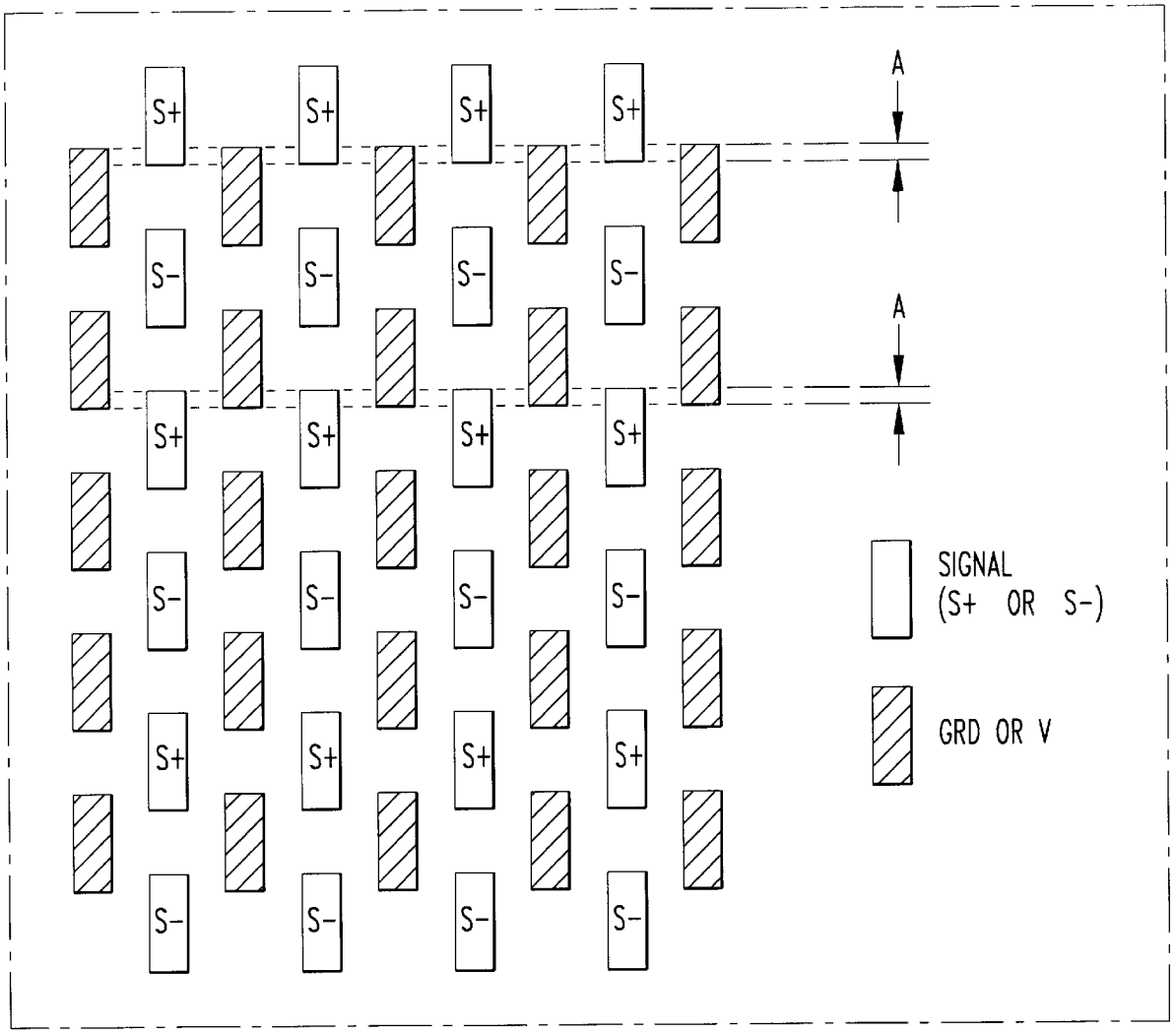
FIG. 12 is an alternate pattern of signal assignments made in accordance with the present invention.
Figure 13:
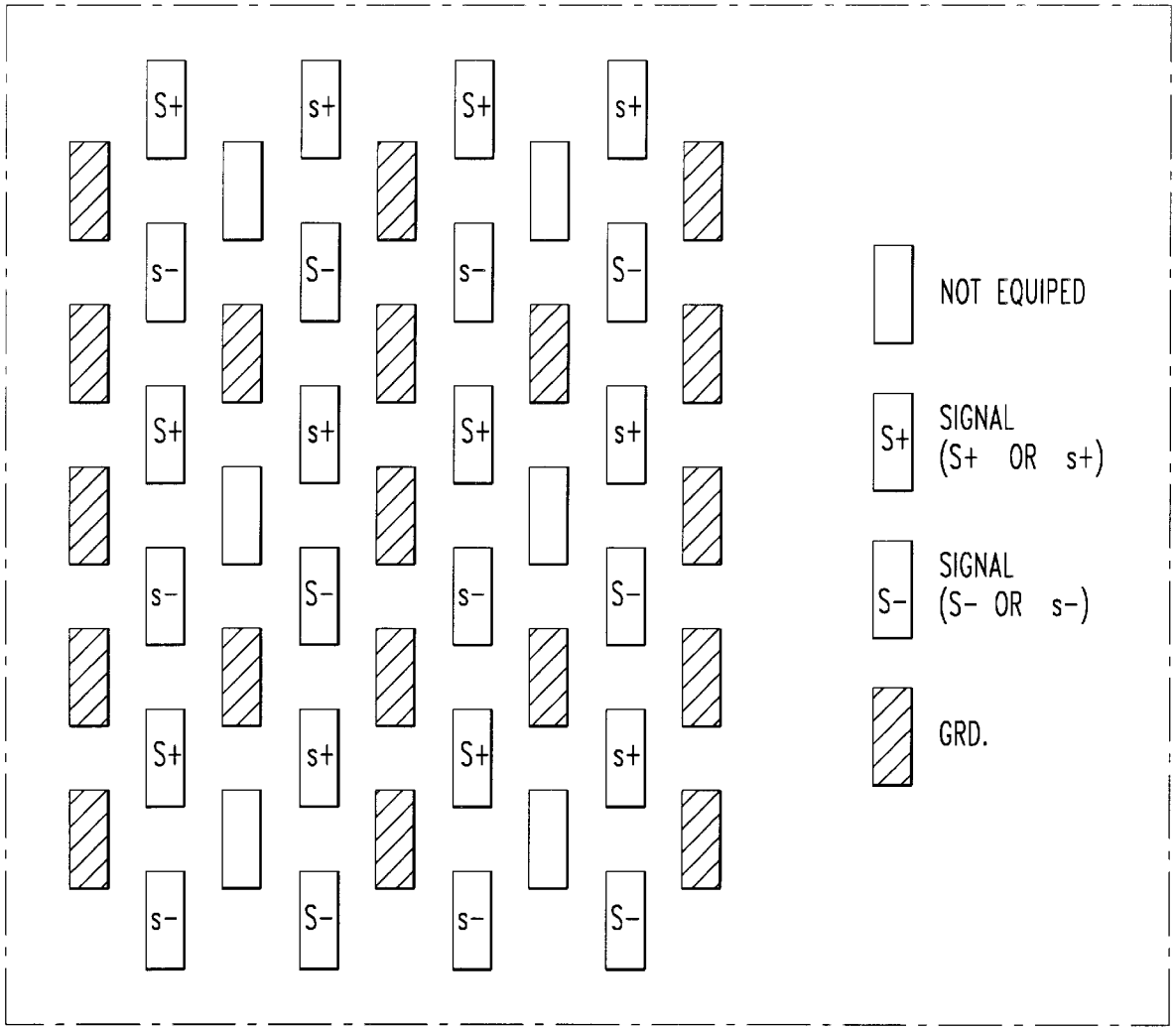
FIG. 13 is an alternate pattern of signal assignments made in accordance with the present invention.

Referring now to FIGS. 11, 12 and 13, various contact element assignments are noted. In FIG. 11, contact elements are assigned in a manner to create a form of strip line structure. The cross hatched elements are connected to ground while the open or blank elements are provided with a signal. In FIG. 12, the contact elements to which a signal is provided are further divided so that differential signals are provided to alternating contact elements. It will be appreciated that a differential signal can take the form of signals which are 180° out of phase with one another thereby forming differential pairs. In FIG. 13, certain of the contact elements connected to ground in FIG. 12 are left unconnected to either ground or to a signal.

It is noted that each column provides a certain amount of overlap to the adjacent column. Two examples of this overlap are depicted in FIG. 12 and designated "A." Although the overlap tends to shield signal carrying contact elements, such overlap is to be minimized in order to minimize capacitance. By minimizing capacitance, one minimizes propagation delay and better matches impedance in a high density contact arrangement. It is preferred that the amount of overlap not exceed one half the width of a contact element.

Before considering an alternative and preferred embodiment of the invention, consider first some limitations of the connector system described above. In such connectors (see FIGS. 11–13), the potential ground contacts are located in adjacent corners of a 2 mm square grid with the signal contacts within a column at 1 mm spacing and with a locus corresponding to the intersection for the square (grid) diagonals of the ground points. The implications, besides rendering a pseudo-coax connector configuration, is for the designer twofold. First, the mutual spacing of the widest portion of the contact assembly between adjacent signal and ground termination is close, making terminal assembly and connector manufacture difficult. Second, a press-fit termination scheme with an effective 1 mm pitch board hole grid is difficult, both in application and track routing. In addition, the impedance on circuit boards drops significantly in such configurations, which could result in impedance mismatches and unduly high reflection and signal distortion at higher frequencies.

Moreover, connector assembly can be difficult due for the following reasons: space limitations; connectors will be prone to short circuit caused by mishandling; and an increase in connector insertion/withdrawal force and hence need to limit the number of mating cycles.

Keeping the foregoing in mind, means were sought to increase the mutual space between adjacent ground and signal terminals, both in the mated assembly and also at the board level. The 45° twist embodiment, described below, is a solution to these problems.

Figure 14:
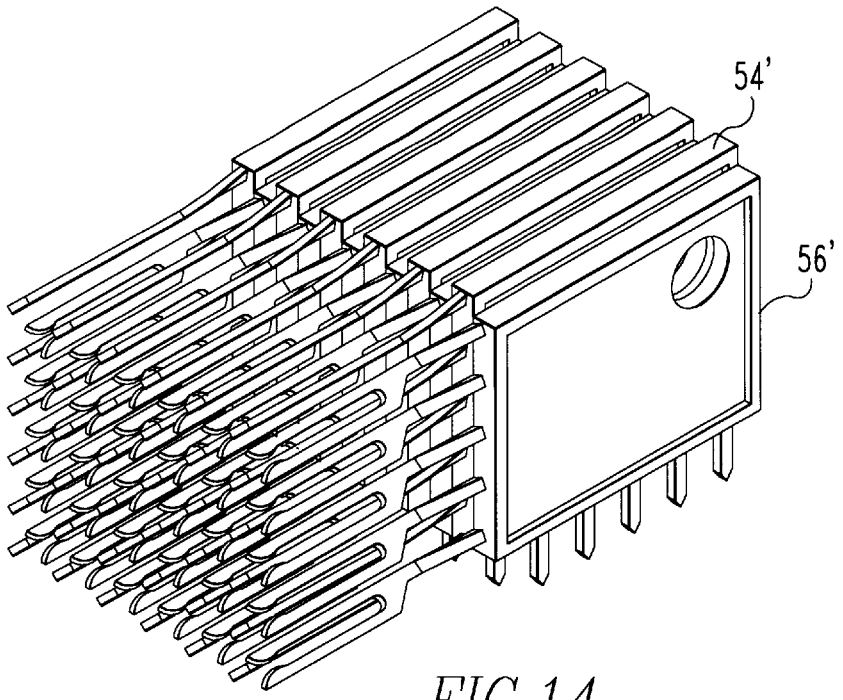
FIG. 14 is a perspective view of an assembled collection of contact modules which are alternative embodiments of the contact modules depicted in cross section in FIGS. 5–8.
Figure 15:
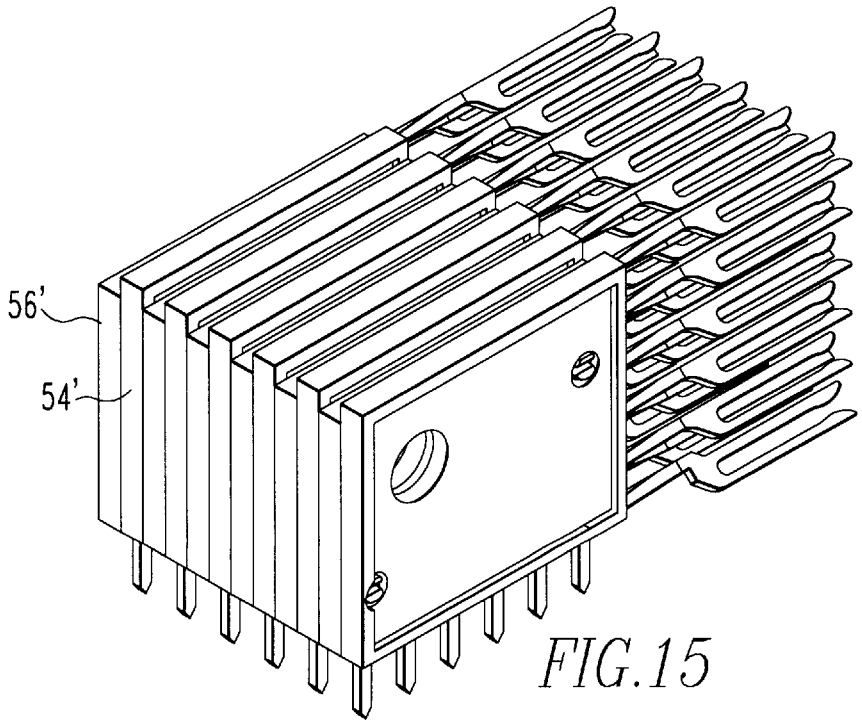
FIG. 15 is an alternate perspective view of an assembled collection of contact modules which are alternative embodiments of the contact modules depicted in cross section in FIGS. 5–8.
Figure 16:
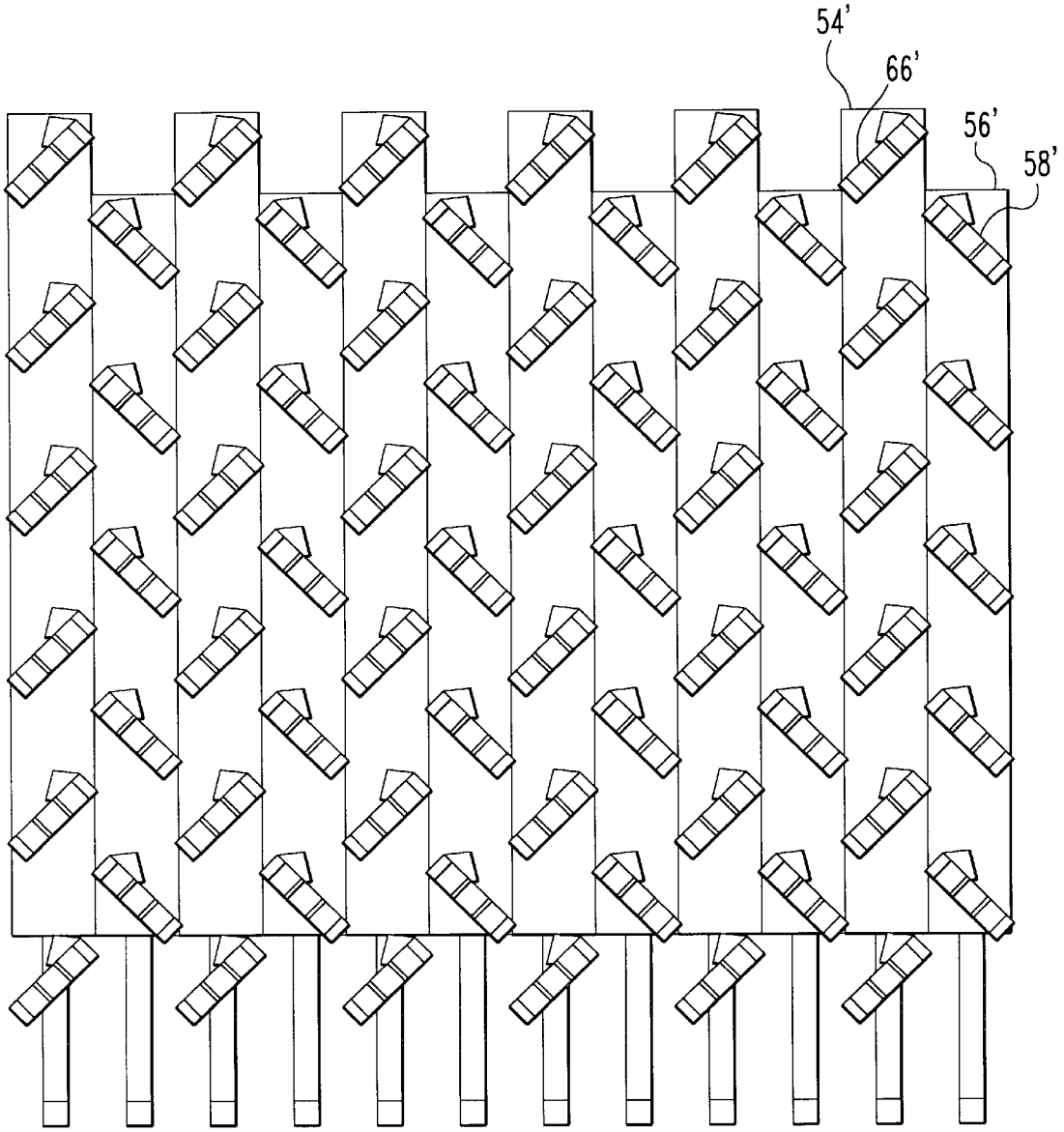
FIG. 16 is a front view of the assembled contact modules depicted in FIGS. 14 and 15.
Figure 17:
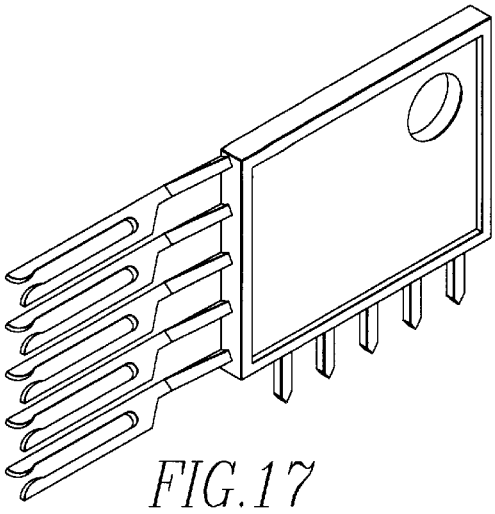
FIG. 17 is a perspective view of one of the contact modules depicted in FIGS. 14 and 15.
Figure 18:
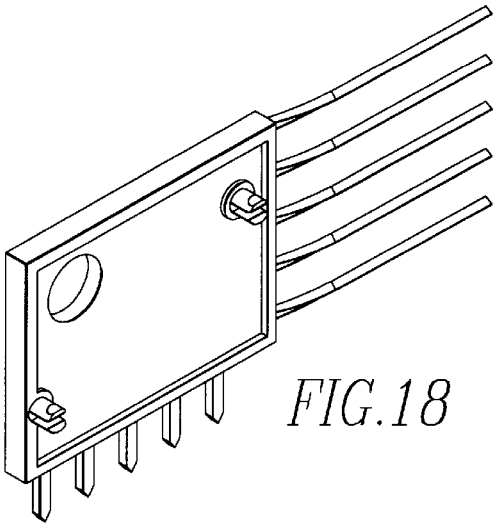
FIG. 18 is an alternate perspective view of one of the contact modules depicted in FIGS. 14 and 15.
Figure 19:
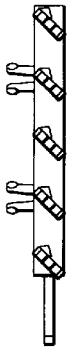
FIG. 19 is a front view of the contact module depicted in FIGS. 17 and 18.
Figure 20:
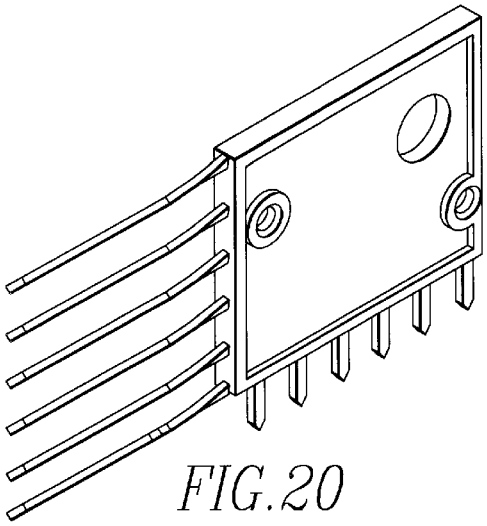
FIG. 20 is a perspective view of another of the contact modules depicted in FIGS. 14 and 15.
Figure 21:
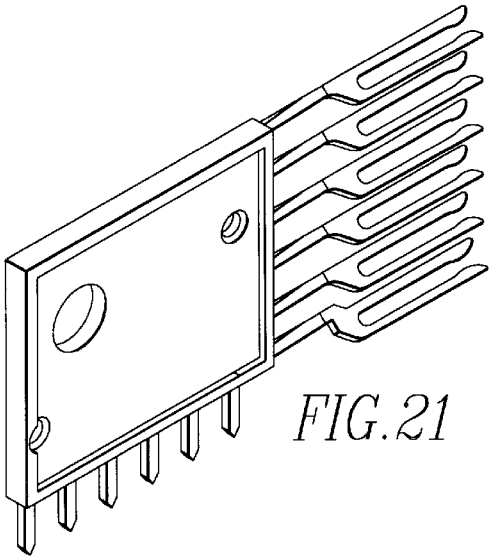
FIG. 21 is an alternate perspective view of another of the contact modules depicted in FIGS. 14 and 15.
Figure 22:
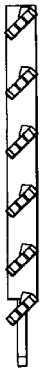
FIG. 22 is a front view of the contact module depicted in FIGS. 20 and 21.

Referring now to FIGS. 14–16, an alternative embodiment is disclosed in which the receiving or receptacle portions of the contact elements have been twisted or rotated approximately 45° from vertical or 45° from the orientation depicted in FIGS. 6 and 8. This twist angle could be any other arbitrarily chosen angle. As shown in FIG. 16, contact elements 58' fixed within module 56' are rotated 45° counterclockwise from vertical while contact element 66' fixed within module 54' are rotated 45° clockwise from vertical. Thus, elements 56' and 58' are generally orthogonal or 90° to one another. The rotation of the contact elements is more particularly depicted in FIGS. 17 through 22.

By twisting each of the contact elements approximately 45° from vertical, the capacitive coupling between contacts is reduced because the distance between contacts within a column is being increased resulting in less cross talk both in the receptacle and in the corresponding header connector. It is noted that this approximately 45° twisting provides a forty percent (40%) increase in spacing between contact elements thereby further reducing capacitance. However, it is also noted that twisting the contact elements also increases the amount of overlap between columns of contact elements. It is further noted that the rear portion of the contact terminal extending from the rear of the retention potion 74' and 82', towards the circuit board (not shown), could also permit a further twist (and or) right angle bend to form a press-fit, thru-mount or surface mount tail end. If flat side pins are used, each such pin must also be rotated about its longitudinal axis.

Figure 23:
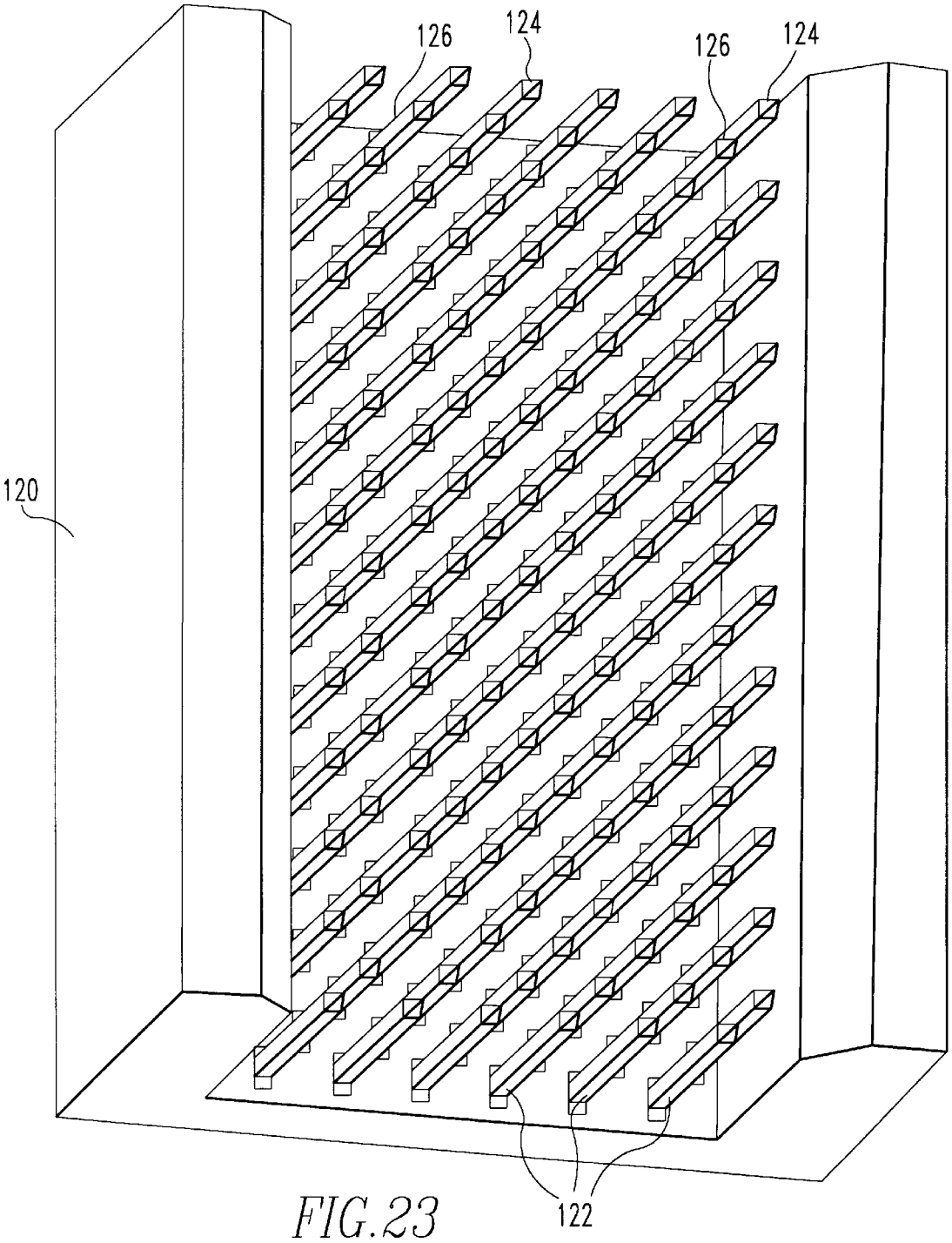
FIG. 23 is a perspective view of a plug constructed in accordance with the invention and particularly adapted for use with the contact module embodiment depicted in FIGS. 14–16.

Referring now to FIG. 23, a pin header 120 constructed in accordance with the invention is depicted. Header 120 is shown to include a plurality of pins 122 arranged in a interstitial pattern. As such, pins 122 are oriented in a series of rows 124 and 126, wherein the pins in one row are in an offset relationship to the pins in the other row. This offset relation results in a pin pattern capable of alignment with openings 44 in front wall 36 depicted in FIG. 1.

Figure 24:
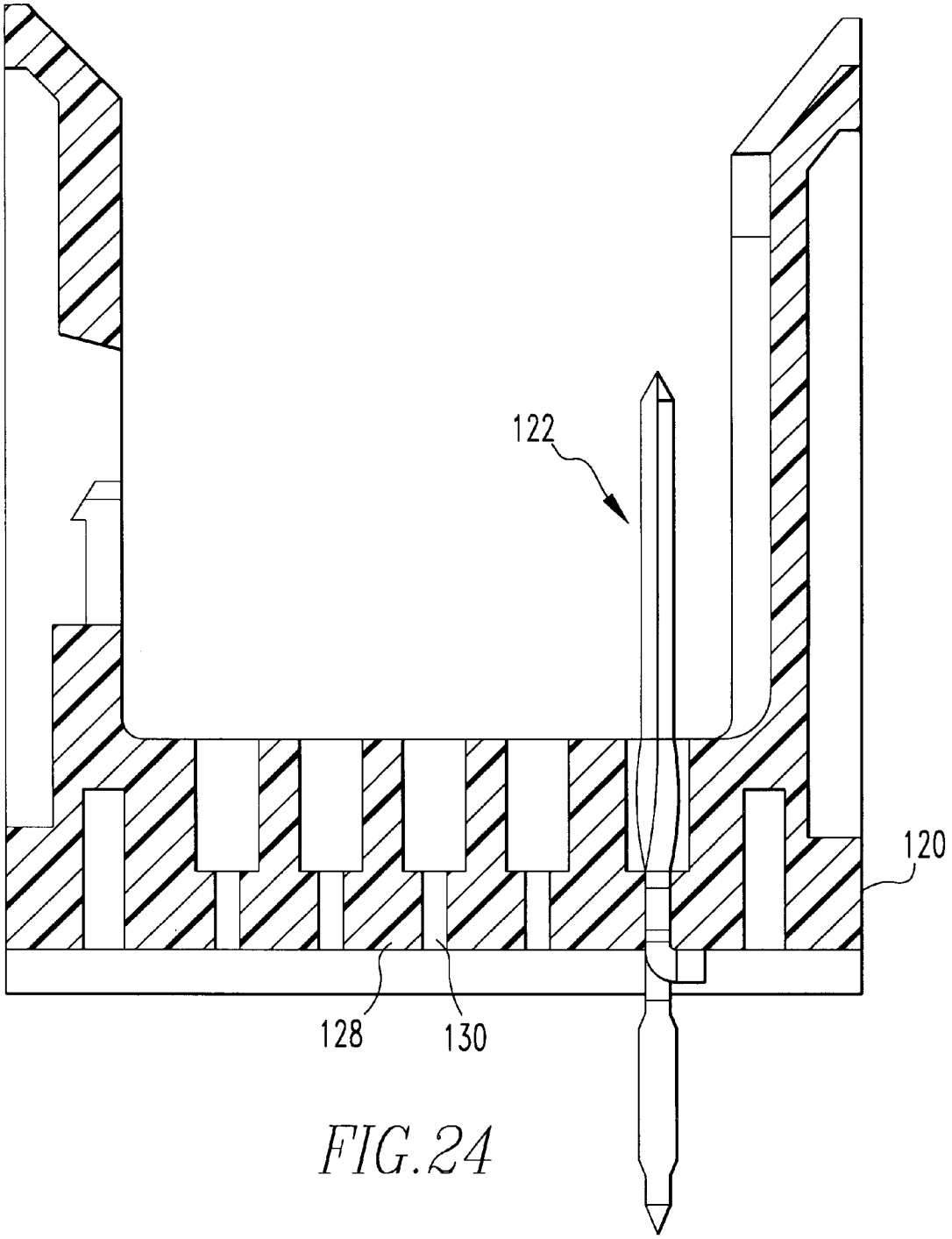
FIG. 24 is a section view of the plug depicted in FIG. 23 in which a pin has been inserted.

As shown in FIG. 24, header 120 includes a body portion 128 through which are formed a series of bores 130. Pins 122 pass through and are fixed within bores 130.

Figure 25:
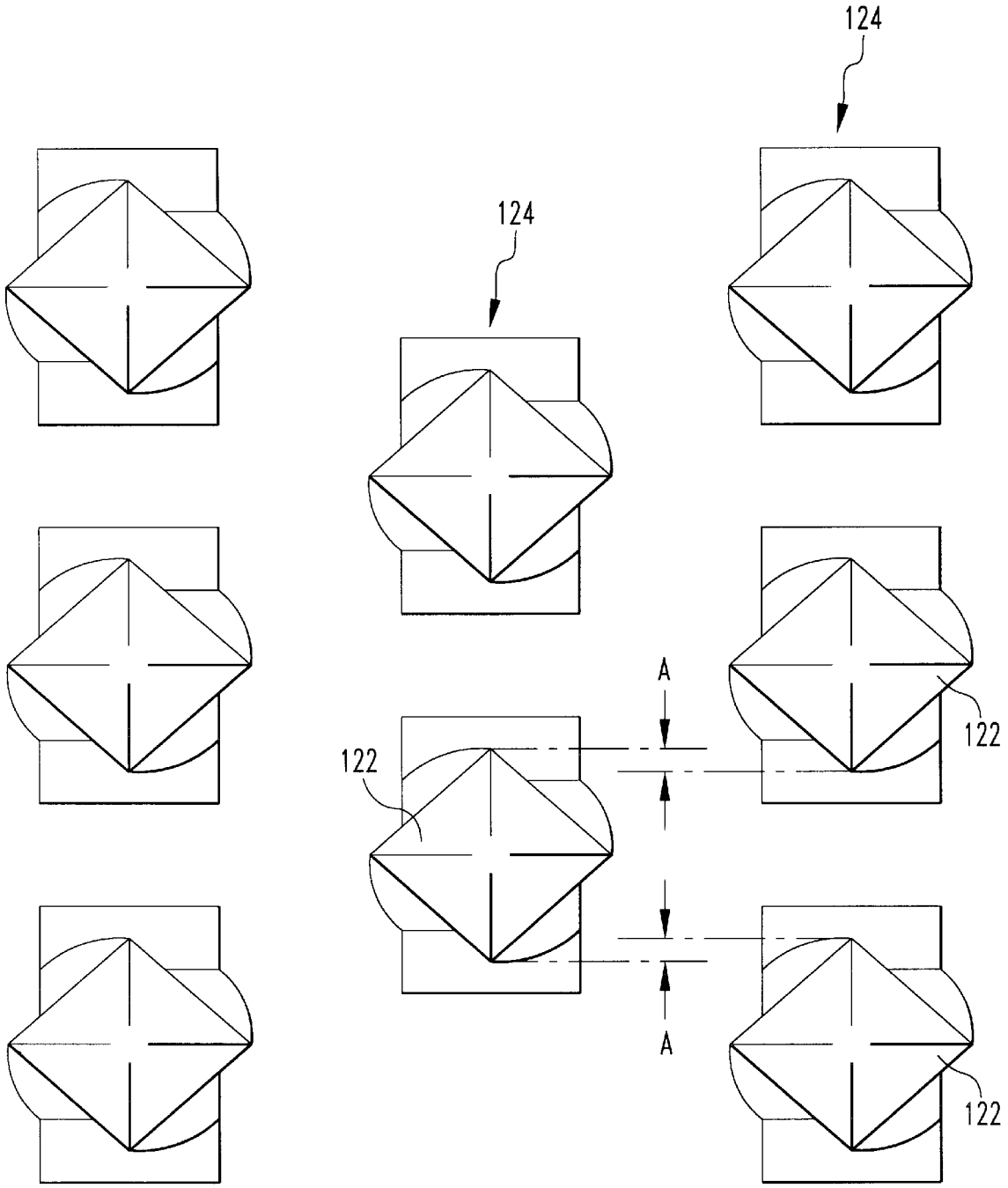
FIG. 25 is a top view of a number of the pins depicted in FIG. 23.

As shown in FIG. 25, pins 122 are constructed so that each side face is oriented at an angle of approximately 45° from vertical or 45° from the orientation depicted in FIGS. 6 and 8. The use of such a construction in conjunction with the interstitial arrangement shown in FIG. 25, results in a small amount of horizontal overlap "A" between adjacent rows. This overlap is an effective electrical overlap and aids in the electrical isolation of pins.

Figure 26:
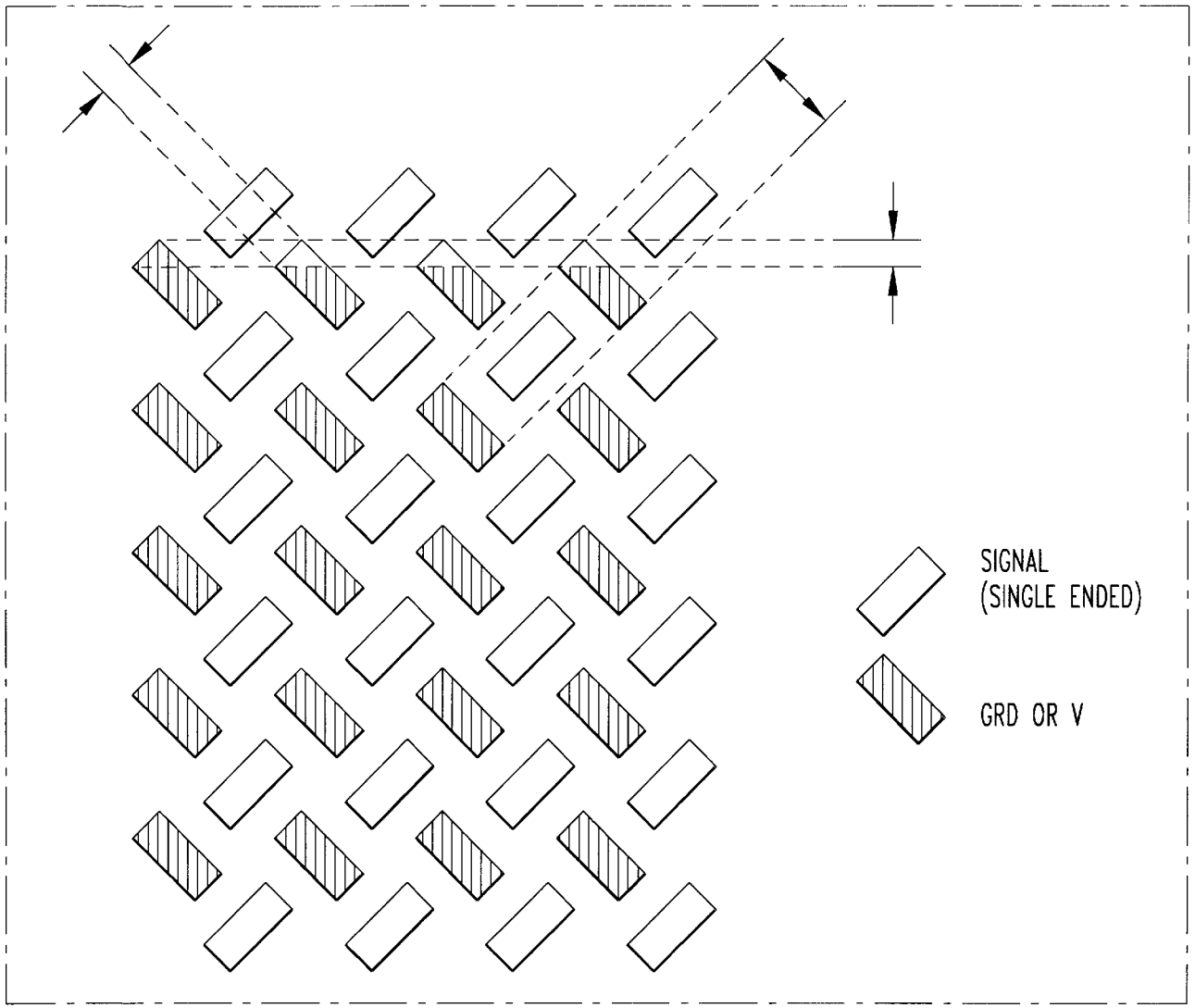
FIG. 26 is an alternate pattern of signal assignments made in accordance with the present invention.

Referring now to FIG. 26, there is shown an assignment pattern for use with the twist embodiment of the invention. It is noted that use of this embodiment results in a increase in overlap which tends to reduce crosstalk for signal assignments such as that depicted, however, increased overlap also serves to increase the effective capacitance of the receptacle.

It is noted that one of the objectives of the connector system described above is to keep the propagation delay time to a value which is lower than the signal rise time. In this manner, any so-called reflection caused by the connector design in relation to a rise in signal voltage will, in effect, be hidden in the next rise time.

While the invention has been described and illustrated with reference to specific embodiments, those skilled in the art will recognize that modification and variations may be made without departing from the principles of the invention as described hereinabove and set forth in the following claims.

What is claimed is:

1. A receptacle, comprising:

a housing portion, having a plurality of openings formed in a front face thereof;

a first column containing a first number of contact elements, wherein each contact element has a receiving portion and a tail portion, said first column being positioned in relation to said housing so that the receiving portions of said contact elements are aligned with certain of said openings; and a second column containing a second number of contact elements generally similar to said contact elements of said first column, different from said first number, wherein each contact element has a receiving portion and a tail portion, said second column being positioned in relation to said housing so that the receiving portions of said contact elements are aligned with other of said openings and wherein when said first and second columns are positioned in relation to said housing, the receiving portions of said first and second columns are laterally and longitudinally offset to one another.

2. The receptacle of claim 1, further comprising a plurality of said first and second columns, wherein said columns are arranged side by side in an alternating pattern.

3. The receptacle of claim 2, wherein said contact elements in adjacent columns partially overlap one another.

4. The receptacle of claim 2, wherein said housing further comprises a cover member and wherein said cover member has a series of projections and recesses formed thereon.

5. The receptacle of claim 4, wherein one edge of said first column is positioned proximate said projection and wherein one edge of said second column is positioned proximate said recess.

6. The receptacle of claim 1, wherein said housing has a top surface and further comprising an alignment projection formed on said top surface.

7. The receptacle of claim 1, wherein said first column comprises a first wafer and wherein said contact elements are attached to said first wafer.

8. The receptacle of claim 7, wherein said first wafer is formed from insulating material.

9. The receptacle of claim 7, wherein said first wafer further comprises a peg formed on one of the side surfaces of said first wafer.

10. The receptacle of claim 9, wherein said peg comprises a split configuration.

11. The receptacle of claim 1, wherein said second column comprises a second wafer and wherein said contact elements are attached to said second wafer.

12. The receptacle of claim 11, wherein said second wafer is formed from insulating material.

13. The receptacle of claim 11, wherein said second wafer has a bore formed thereon.

14. The receptacle of claim 1, wherein said first and second numbers differ by one.

15. The receptacle of claim 1, wherein said first and second columns respectively comprise first and second wafers and projections, wherein said projections serve to space the wafers from one another.

16. The receptacle of claim 15, wherein said projections comprise shoulders extending along the edges of said first and second wafers.

17. A receptacle, comprising:

a housing portion, having a plurality of openings formed in a plurality of columns on a front face thereof;

a first plurality of columns containing a first number of contact elements, wherein each contact element has a receiving portion and a tail portion, said first columns being positioned in relation to said housing so that the receiving portions of said contact elements of each said first column are aligned with a respective column of said openings; and a second plurality of columns containing a second number of contact elements generally similar to said contact elements of said first columns, different from said first number, wherein each contact element has a receiving portion and a tail portion, said second columns being positioned in relation to said housing so that the receiving portions of said contact elements of each second column are aligned with a respective column of said openings in an alternating manner with said first columns.

18. The receptacle of claim 17, wherein all of said receiving portions are preselected to receive desired signals.

19. The receptacle of claim 17, wherein the receiving portions of said first columns are preselected to be connected to ground.

20. The receptacle of claim 19, wherein the receiving portions of said second columns are preselected so that adjacent receiving portions each receive differential signals.

21. A receptacle, comprising:

a housing portion comprising a front wall, said front wall having a plurality of openings formed in a front face thereof; and a contact element column comprising:

a plurality of contact elements, wherein each contact element has a forward portion fixed by said front wall and aligned with a respective opening in said front wall, a middle portion, a fixing portion and a tail portion; and a fixing member positioned away from said front wall of said housing to form a space therebetween, wherein said fixing portions of said contact elements are attached to said fixing member so that said contact elements are fixed and aligned relative to one another, said middle portions located within said space between said fixing member and said front wall and being surrounded by air.

22. The receptacle of claim 21, wherein said contact element comprises a twist portion which serves to orient the forward portion of the contact element at an angle in relation to said column.

23. The receptacle of claim 22, wherein said angle is 45°.

24. The receptacle as recited in claim 22, wherein each of said forward portions of said contact elements have a generally similar orientation relative to said column.

25. The receptacle as recited in claim 22, further comprising a second contact element column adjacent said first contact element column, wherein said forward portions of said contact elements in said first contact element column have orientations, and said forward portions of said contact elements in said second contact element column have orientations generally opposite said orientations of said forward portions of said contact elements in said first contact element column.

* * * * *